US005529551A

United States Patent [19]

Chin

[11] Patent Number: 5,529,551

[45] Date of Patent: Jun. 25, 1996

[54] GRIPPING-AND-COMPRESSING TYPE EXERCISER WITH ADJUSTABLE COMPRESSIVE RESISTANCE

[76] Inventor: Taan K. Chin, 7th Fl., No. 227, Sec. 3, Roosevelt Rd., Taipei, Taiwan

[21] Appl. No.: 425,147

[22] Filed: Apr. 19, 1995

[51] Int. Cl.[6] ..... A63B 23/16

[52] U.S. Cl. ..... 482/49; 482/127; 482/126

[58] Field of Search ..... 482/44, 49, 127, 482/128, 126

[56] References Cited

U.S. PATENT DOCUMENTS 4,753,434 6/1988 Salvino ..... 482/49

5,072,927 12/1991 Santos ..... 482/49

5,222,926 6/1993 Eggen ..... 482/49

5,360,385 11/1994 Wang ..... 482/49

*Primary Examiner*—Lynne A. Reichard

*Attorney, Agent, or Firm*—Hedman, Gibson & Costigan

[57] ABSTRACT

A gripping-and-compressing type exerciser with adjustable compressive resistance includes a pair of gripping arms, a resilient member having a closable gap and being coupled to the arms, and a resistance member having different compressive resistances and adjustably received in the resilient member to adjust a resistance of closing up the gap and thereby adjusting the compressive resistance of the exerciser.

8 Claims, 7 Drawing Sheets

GRIPPING-AND-COMPRESSING TYPE EXERCISER WITH ADJUSTABLE COMPRESSIVE RESISTANCE

BACKGROUND OF THE INVENTION

1. Field of the Invention

The present invention relates to a gripping-and-compressing type exerciser, such as, a hand gripping exerciser, a torso exerciser and the like, and, more particularly, to a gripping-and-compressing type exerciser having an adjustable resistance means.

2. Description of Related Art

A gripping-and-compressing type exerciser, for instance, a hand gripping exerciser as shown in FIG. 8, conventionally comprises two gripping arms 82 respectively connected to a respective end of a pre-loaded metal spring 84 forming a substantially V-shaped configuration. A major drawback of this type of gripping-and-compressing exerciser is that an exercising resistance provided by a gripping-and-compressing exerciser is fixed. That is, one gripping-and-compressing exerciser can only provide a predetermined, unadjustable exercising resistance. Therefore, a user has to buy a series of gripping-and-compressing exercisers having various exercising resistances along his workout process to meet his needs at different stages. This is uneconomic not only from the customer's expense point of view but also from the resource utilization point of view.

Therefore, there has been a long and unfulfilled need for a gripping-and-compressing exerciser can provide various exercising resistances to meet different users' needs.

SUMMARY OF THE INVENTION

One object of the present invention is to present a gripping-and-compressing type exerciser which can adjustably provides a variety of compressive resistances.

Another object of the present invention is to provide an improved gripping-and-compressing type exerciser whose compressive resistance can be easily adjusted by a user to meet his needs.

The above-mentioned objects of the present invention are achieved by providing a gripping-and-compressing exerciser which comprises a pair of gripping arms; an arcuated resilient means having two ends defining a closable gap therebetween and respectively connected to an end of respective one of the arms, a stopping element and a number of positioning elements, the gap to be closed up as it subjected to a compressive force; and an arcuated resistance means having different compressing resistances along a curvature thereof and being movably received in the resilient means for adjustably increasing a compressing resistance of the resilient means by aligning different portions thereof with the gap, the resistance means comprising a plurality of engaging elements selectable interlocking with the positioning elements for maintaining a portion thereof in alignment with the gap and a flange element engagable with the stopping element to prevent the resistance means from escaping out of the resilient means as the resistance means is moved to disengage the engaging elements from the positioning elements for rotatably altering the curvature portion aligning with the gap to thereby adjusting the compressing resistance of the exerciser.

In accordance with one aspect of the present invention, the resilient means is a sleeve having a substantially C-shaped cross-section, the stopping element is a peripheral recess axially defined at an inner periphery of a first end face of the sleeve, and the positioning elements are notches disposed around an inner periphery of a second end face of the sleeve.

The resistance means is an eccentric cylinder having a continuously varied wall thickness and an axial opening defined in a portion of the wall whose wall thickness is the thinnest, the flange element radially protrudes outward from a first end face of the eccentric cylinder, and the engaging elements are ridges radially protrude outward from an outer peripheral surface adjacent to a second end face of the eccentric cylinder.

In accordance with another aspect of the present invention, the resistance means is a cylinder having a substantially W-shaped cross-section, the flange element radially protrudes outward from a first end face of the resistance means, and the engaging elements are ridges radially protrude outward from an outer peripheral surface adjacent to a second end of the resistance means.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
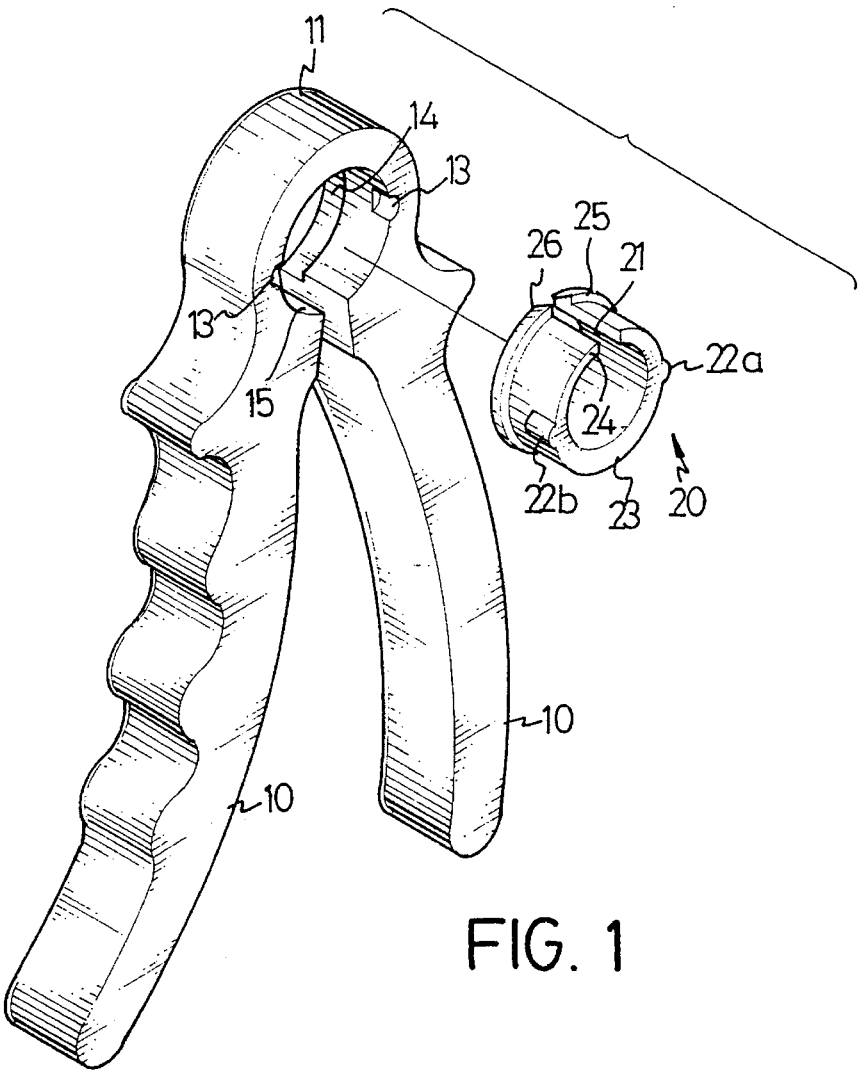
FIG. 1 is an exploded perspective view of a had gripping exerciser in accordance with an embodiment of the present invention.

Before going into details of the present invention one thing has to be clarified. That is, since there are a variety of exercisers can be classified as a gripping-and-compressing type exerciser, such as a hand gripping exerciser and a torso exerciser, a hand gripping exerciser in accordance with the present invention is described hereinafter for explanatory purpose only. It is not to limit the present invention to a hand gripping exerciser only. Referring now to the drawings and initially to FIG. 1, the hand gripping exerciser in accordance with the present invention generally includes a pair of gripping arms 10, a resilient means 11, and a resistance means 20. The resilient means 11 is C-shaped with two distal tips defining a gap 15 therebetween. Preferably, each of the distal tips has an integrally formed gripping arm 10 extending obliquely therefrom and away from each other. The resilient means comprises a peripheral stopping recess 14 axially defined at an inner periphery of a first end face thereof, and two positioning notches 13 disposed around an inner periphery of a second end face thereof. When the resilient means 11 is subjected to a compressive force, the gap 15 will be closed up and will be re-opened up to its initial position owing to the resilient nature of the resilient means as the compressive force is released.

The resistance means 20 preferably is an eccentric cylinder having a continuously varied wall thickness, an axial opening 21 defined in a portion of the wall 24 whose wall thickness is the thinnest, a flange 25 radially protruding outward from a first end thereof, and two engaging ridges 22*a*, 22*b* radially protruding outward from an outer peripheral surface adjacent to a second end thereof.

Figure 2B:
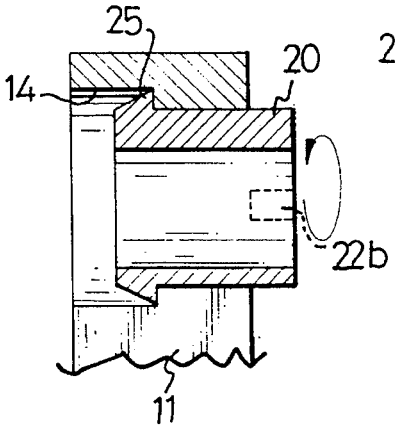
FIGS. 2A and 2B are partial cross-sectional views of FIG. 1 showing the adjusting steps of the exerciser.
Figure 2A:
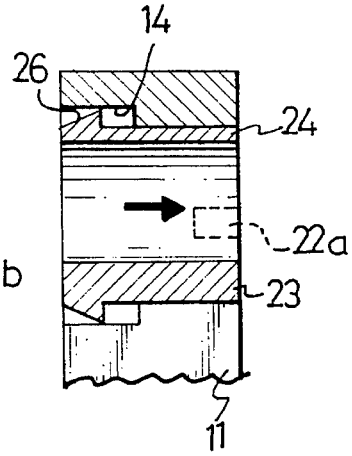

The resistance means 20 is inserted into the resilient means 11 to increase a resistance of closing up the gap 15 by aligning a portion thereof with the gap 15. Preferably, the flange 25 has an inclined outer face 26 to facilitate this insertion. When the resistance means 20 is received in the resilient means 11, a rotational movement therebetween is restricted because the ridges 22*a*, 22*b* interlock with the notches 13 and a limited axial movement is possible, as shown in FIG. 2A. As the resistance means 20 is manually pushed a distance in a direction indicated in FIG. 2A which is sufficient to disengage the ridges 22*a*, 22*b* from the notches 13, the resistance means 20 is rotatable relative the resilient means 11 to change the portion aligning with the gap 15 and to thereby adjusting the resistance of the exerciser, as shown in FIG. 2B.

Figure 3:
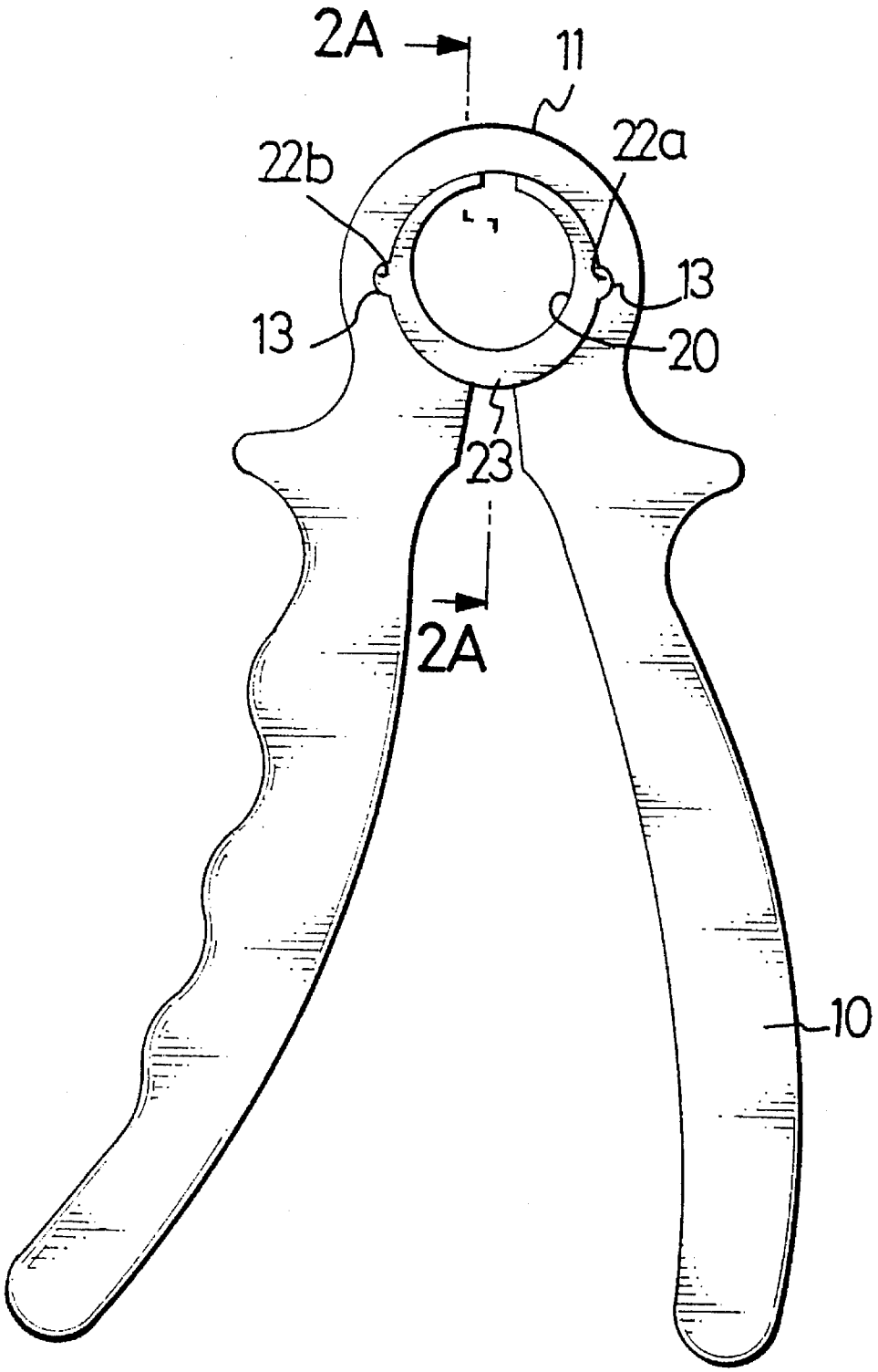
FIGS. 3 and 4 are assembled front views of FIG. 1 showing a first and a second using modes thereof.
Figure 4:
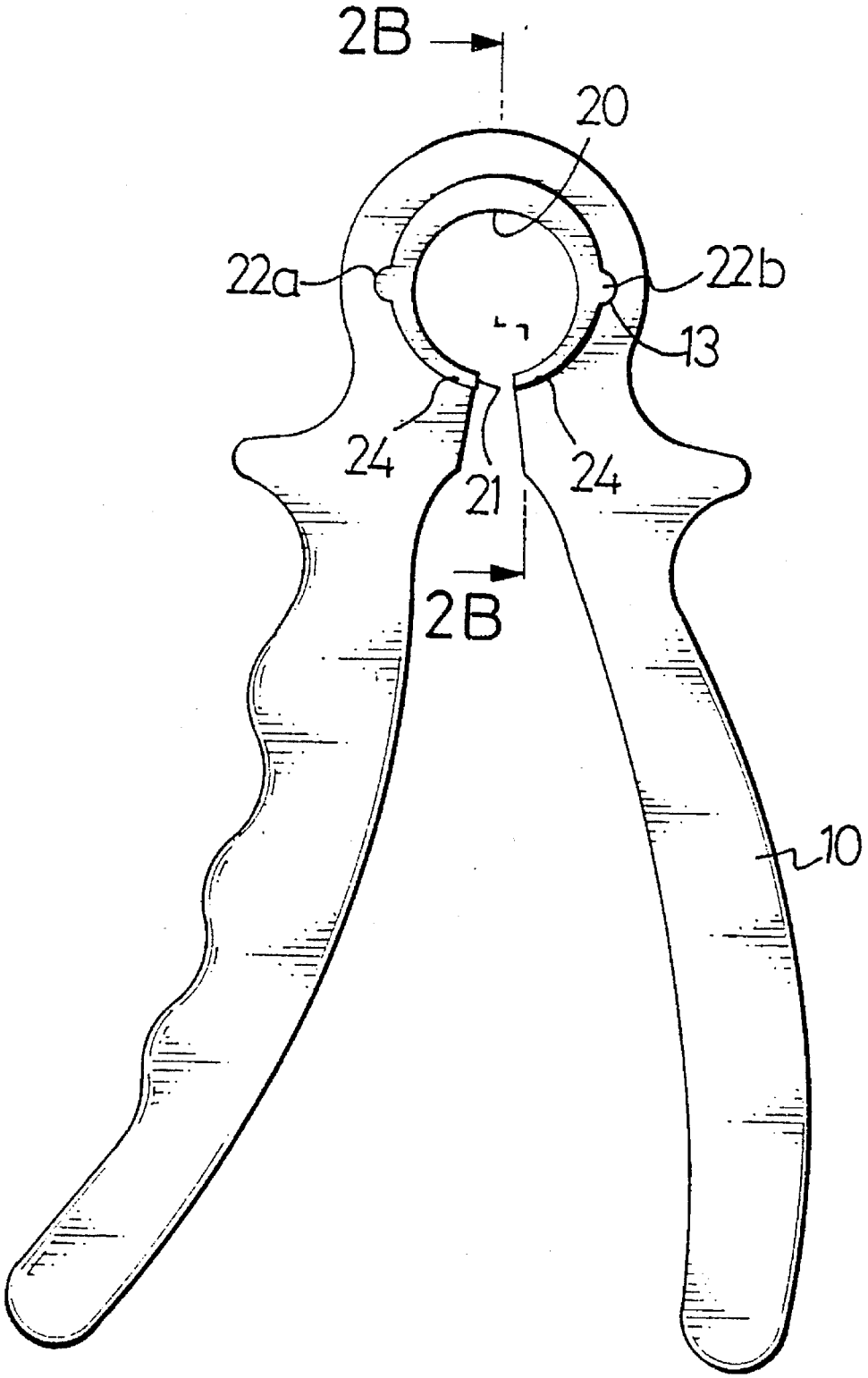
Figure 5:
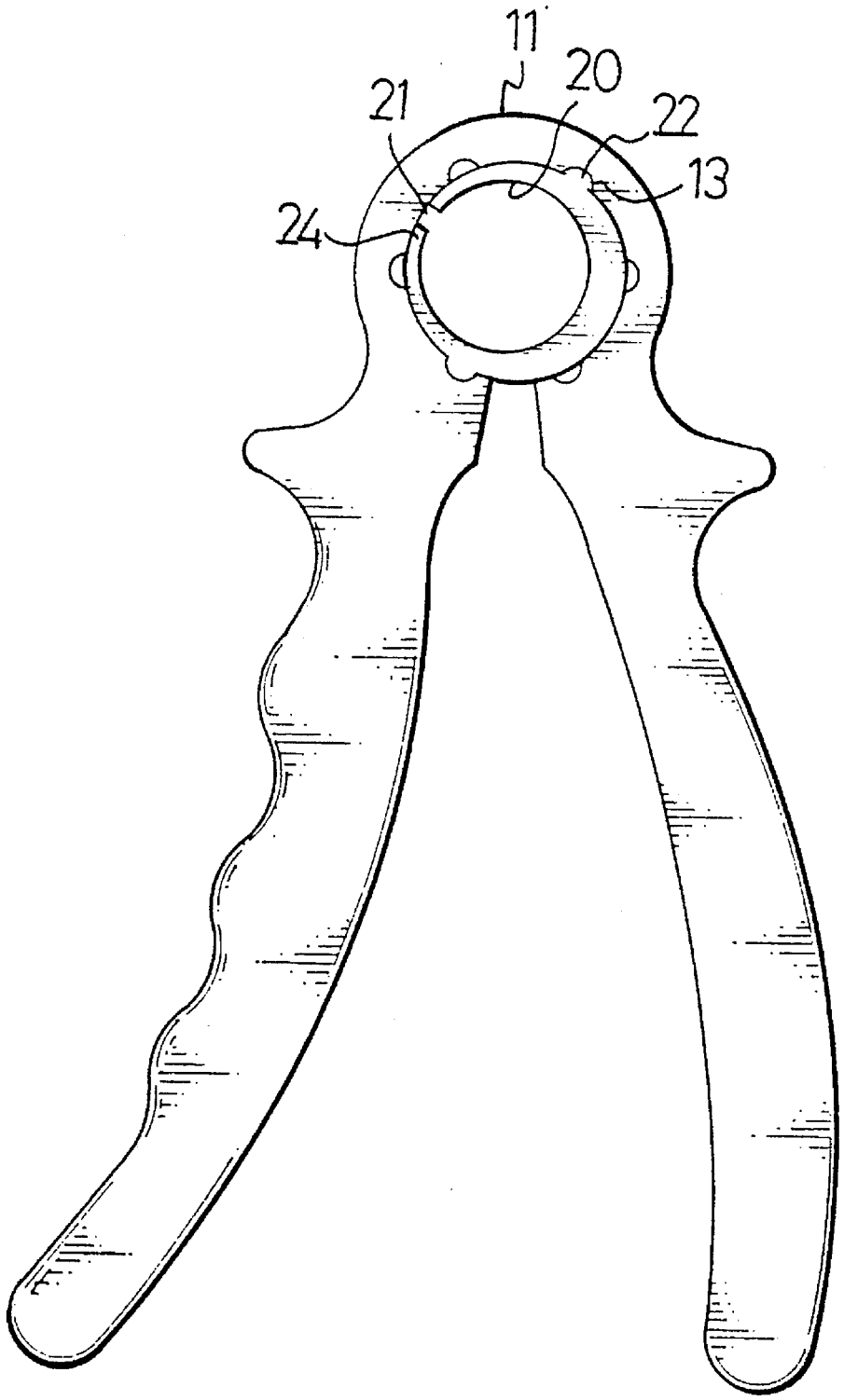
FIG. 5 is a front view of another embodiment of a hand gripping exerciser in accordance with the present invention.
Figure 6:
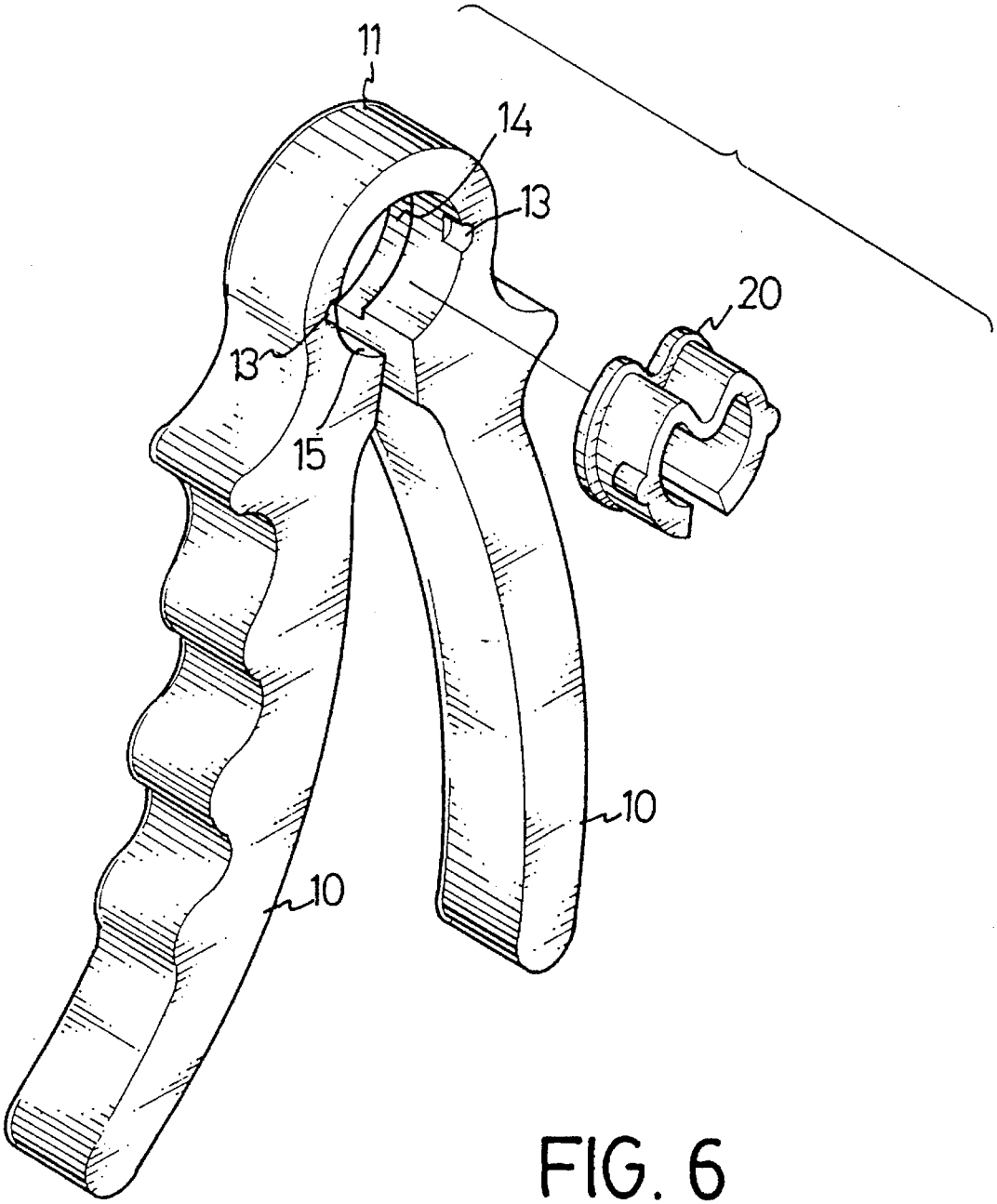
FIG. 6 is a perspective view of another embodiment of the hand gripping exerciser in accordance with the present invention.
Figure 7:
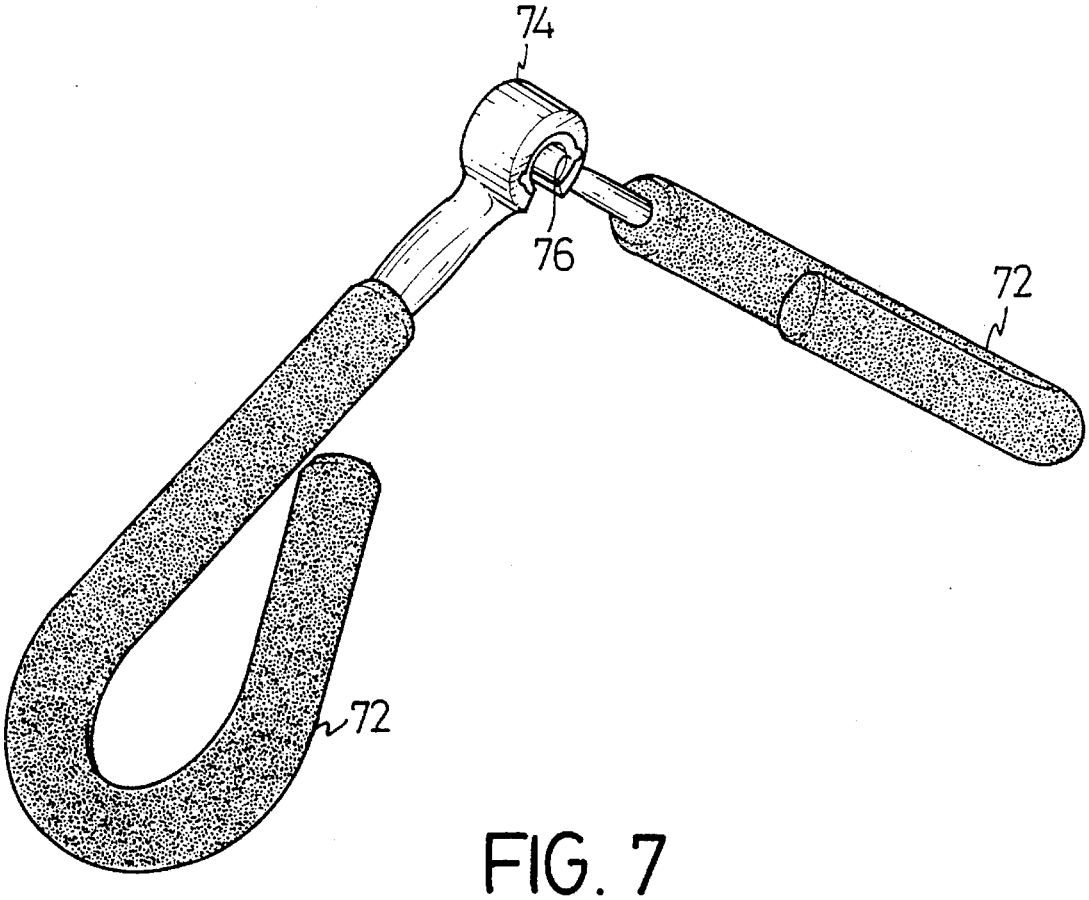
FIG. 7 is perspective view of a torso exerciser in accordance with another embodiment of the present invention.
Figure 8:
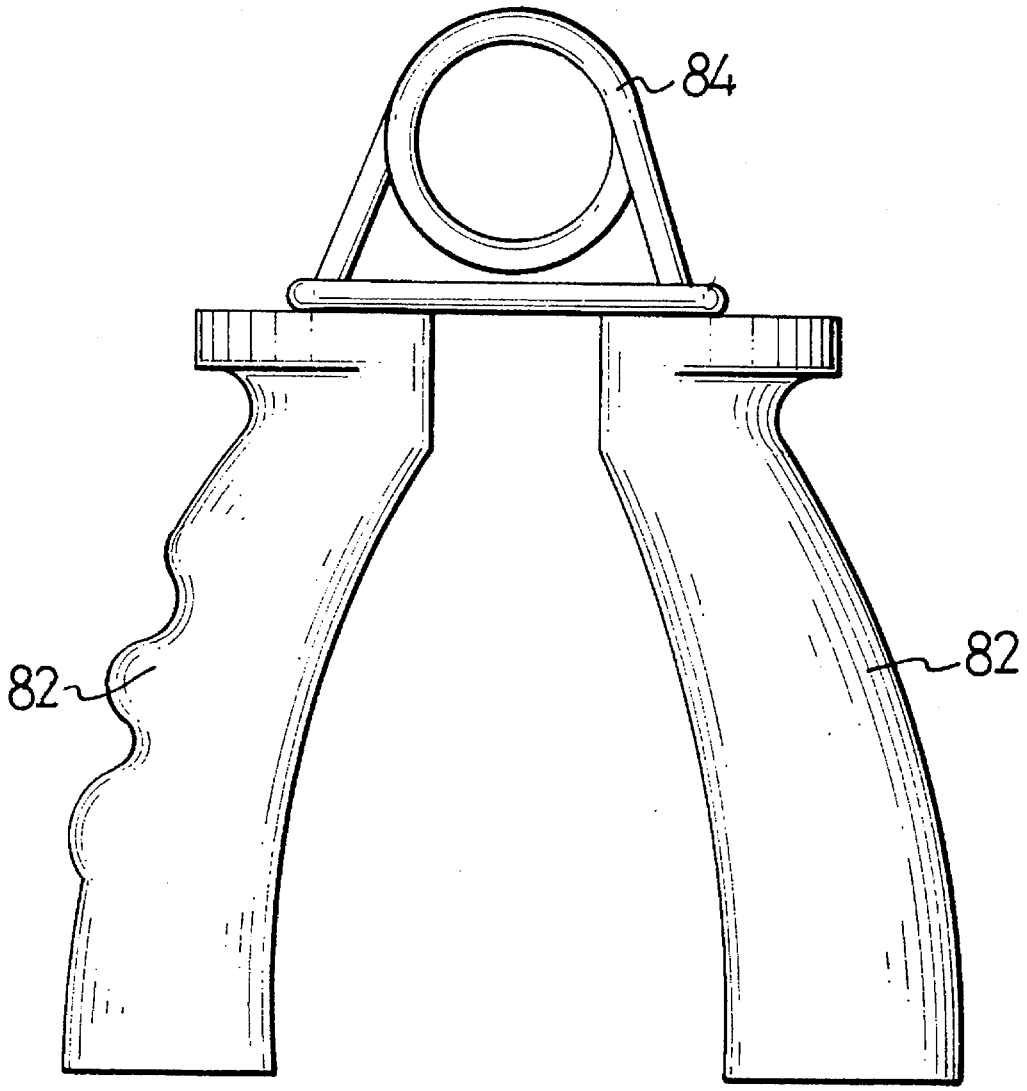
FIG. 8 PRIOR ART
FIG. 8 is a front view of a well known hand gripping exerciser.

FIG. 3 shows a using mode of the hand gripping exerciser that a thicker wall thickness 23 of the resistance means 20 aligns with the gap 15 therefore has a stronger resistance than a using mode shown in FIG. 4 which the opening 21 is in alignment with the gap 15. Preferably, the resilient means 11 and the resistance means 20 has more than two notches 13 and ridges 22 respectively, as shown in FIG. 5. FIG. 6 illustrates another preferred embodiment of the resistance means 20 having an uniform wall thickness and a W-shaped cross-section which also provides different resistances to the exerciser as it is oriented differently within the resilient means 11. FIG. 7 illustrates a torso exerciser 70 in accordance with the present invention comprising a pair of arms 72, a resilient means 74 and an adjustable resistance means 76.

Although the invention has been explained in relation to its preferred embodiments, it is to be understood that many other possible modifications and variations can be made without departing from the spirit and scope of the invention as hereinafter claimed.

I claim:

1. A gripping-and-compressing exerciser with adjustable compressive resistance comprising:

a pair of gripping arms;

an arcuate resilient means having two ends defining a closable gap therebetween and each end respectively connected to an end of a respective one of the arms, a stopping element and a number of positioning elements, the gap to be closed up when it is subjected to a compressive force; and an arcuate resistance means having different compressing resistances along a curvature thereof and being movably received in the arcuate resilient means for adjustably increasing a compressing resistance of the arcuate resilient means by aligning different portions thereof with the gap, the arcuate resistance means comprising a plurality of engaging elements selectably interlocking with the positioning elements for maintaining a portion thereof in alignment with the gap and a flange element engagable with the stopping element to prevent the arcuate resistance means from escaping out of the arcuate resilient means as the arcuate resistance means is moved to disengage the engaging elements from the positioning elements for rotatably altering the curvature portion aligning with the gap to thereby adjust the compressing resistance of the exerciser.

2. The gripping-and-compressing exerciser as claimed in claim 1, wherein the arcuate resilient means is a tube having a substantially "C"-shaped cross-section, the stopping element is a peripheral recess axially defined at an inner periphery of a first end face of the tube, and the positioning elements are notches disposed around an inner periphery of a second end face of the tube.

3. The gripping-and-compressing exerciser as claimed in claim 2, wherein the arcuate resistance means is an eccentric cylinder having a continuously varied wall thickness and an axial opening defined in a portion of the wall where its wall thickness is the thinnest, the flange element radially protrudes outward from a first end face of the eccentric cylinder, and the engaging elements are ridges radially protruding outward from an outer peripheral surface adjacent to a second end face of the eccentric cylinder.

4. The gripping-and-compressing exerciser as claimed in claim 2, wherein the arcuate resistance means is a cylinder having a substantially "W"-shaped cross-section, the flange element radially protrudes outward from a first end face of the arcuate resistance means, and the engaging elements are ridges radially protruding outward from an outer peripheral surface adjacent to a second end of the arcuate resistance means.

5. The gripping-and-compressing exerciser as claimed in claim 1, wherein the gripping arms and the two ends of the arcuate resilient means are integrally formed.

6. A compressive resistance adjusting structure for a gripping-and-compressing type exerciser having a pair of gripping arms comprising:

a cylindrical resilient means having:

an axial opening defined in a wall thereof, each of two sides of the opening having means for being respectively coupled to an end of a respective one of the arms of the exerciser;

a stopping peripheral recess axially defined from a first end face and in an inner peripheral surface of the cylindrical resilient means; and a number of positioning notches disposed around an inner periphery of a second end face of the cylindrical resilient means; and an arcuate resistance means having different compressive resistances along a curvature thereof and being movably received in the cylindrical resilient means for adjustably increasing a compressing resistance of the cylindrical resilient means by aligning different portions thereof with the opening, the arcuate resistance means comprising a plurality of engaging elements selectably interlocking with the positioning notches for maintaining a portion thereof in alignment with the opening and a flange element engagable with the stopping peripheral recess to prevent the arcuate resistance means from escaping out of the cylindrical resilient means as the arcuate resistance means is moved to disengage the engaging elements from the positioning notches for rotatably altering the curvature portion aligning with the opening to thereby adjust the compressing resistance of the cylindrical resilient means.

7. The resistance adjusting structure as claimed in claim 6, wherein the arcuate resistance means is an eccentric cylinder having a continuously varied wall thickness and an axial opening defined in a portion of the wall where its wall thickness is a thinnest portion, the flange element radially protrudes outward from a first end face of the eccentric cylinder, and the engaging elements are ridges radially protruding outward from an outer peripheral surface adjacent to a second end face of the eccentric cylinder.

8. The resistance adjusting structure as claimed in claim 6, wherein the arcuate resistance means is a cylinder having a substantially "W"-shaped cross-section, the flange element radially protrudes outward from a first end face of the cylinder, and the engaging elements are ridges radially protruding outward from an outer peripheral surface adjacent to a second end of the cylinder.

* * * * *